US006276088B1

(12) United States Patent
Matthews et al.

(10) Patent No.: US 6,276,088 B1
(45) Date of Patent: Aug. 21, 2001

(54) FIREARMS WITH TARGET ILLUMINATORS

(75) Inventors: John Wallace Matthews, Newport Beach; Paul Youngcho Kim, Westminster, both of CA (US)

(73) Assignee: Laser Products Ltd., Fountain Valley, CA (US)

( * ) Notice: Subject to any disclaimer, the term of this patent is extended or adjusted under 35 U.S.C. 154(b) by 0 days.

(21) Appl. No.: 09/219,564

(22) Filed: Dec. 24, 1998

Related U.S. Application Data

(62) Continuation-in-part of application No. 08/985,556, filed on Dec. 5, 1997, now Pat. No. 6,046,572, and a continuation-in-part of application No. 08/849,566, filed as application No. PCT/US95/09471 on Jul. 26, 1995, now Pat. No. 6,112,962.

(51) Int. Cl.[7] ..... F41G 1/34
(52) U.S. Cl. ..... 42/103; 362/110
(58) Field of Search ..... 42/103; 33/241; 362/110

(56) References Cited

U.S. PATENT DOCUMENTS

| | | | | |
|---|---|---|---|---|
| 1,338,239 | * | 4/1920 | Matys | 362/114 |
| 2,236,736 | | 4/1941 | Scott | 240/6.41 |
| 2,450,584 | * | 10/1948 | Dodge | 42/103 |
| 2,491,431 | | 12/1949 | Unertl et al. | 33/50 |
| 4,021,954 | | 5/1977 | Crawford | 42/1 ST |
| 4,313,272 | | 2/1982 | Matthews | 42/1 A |
| 4,348,716 | | 9/1982 | Storm et al. | 361/188 |
| 4,383,371 | | 5/1983 | Coffey | 33/245 |
| 4,542,447 | * | 9/1985 | Quakenbush | 362/183 |
| 4,777,754 | | 10/1988 | Reynolds, Jr. | 42/103 |
| 4,814,957 | | 3/1989 | Dennis | 362/187 |
| 4,856,218 | | 8/1989 | Reynolds, Jr. | 42/103 |
| 5,208,826 | | 5/1993 | Kelly | 372/107 |
| 5,299,375 | | 4/1994 | Thummel | 42/103 |
| 5,323,555 | | 6/1994 | Jehn | 42/103 |
| 5,430,967 | * | 7/1995 | Woodman, III et al. | 42/103 |
| 5,471,777 | | 12/1995 | McDonald | 42/103 |
| 5,522,167 | * | 6/1996 | Teetzel | 42/103 |
| 5,581,898 | | 12/1996 | Thummel | 33/241 |
| 5,584,137 | * | 12/1996 | Teetzel | 42/103 |
| 5,628,555 | | 5/1997 | Sharrah et al. | 362/114 |
| 5,654,594 | | 8/1997 | Bjornsen, III et al. | 307/115 |
| 5,669,174 | * | 9/1997 | Teetzel | 42/103 |
| 5,671,561 | | 9/1997 | Johnson et al. | 42/103 |
| 5,694,712 | | 12/1997 | Plonka | 42/101 |
| 5,758,448 | | 6/1998 | Thummel | 42/103 |
| 5,816,683 | * | 10/1998 | Christiansen | 362/110 |
| 6,023,875 | * | 2/2000 | Fell et al. | 42/103 |

* cited by examiner

*Primary Examiner*—Charles T. Jordan
*Assistant Examiner*—Denise J Buckley

(57) ABSTRACT

Apparatus for firing projectiles at targets and for illuminating such targets combine a projectile-firing weapon and a target illuminator. A track-and-slide combination includes a slide on the target illuminator and a track on the weapon for that slide, and a releasable slide-in-track stop in such track-and-slide combination. In the case of a firearm that has a trigger actuated by a bent trigger finger of a shooter for the firing thereof, a push-button or transverse slide switch for the target illuminator may be mounted within reach of a pad of such trigger finger prior to actuation of the trigger. For example, the shooter may draw the firearm with his or her trigger finger then outstretched for actuation of the target illuminator switch, and may then bend such trigger finger for firing of the weapon by actuation of the trigger. Such and other appliances may have a battery compartment, and a contact plate interconnecting batteries in such compartment. A contact plate retainer may be coupled to that contact plate, and a contact plate retainer receptacle may be provided therefor in the battery compartment.

23 Claims, 4 Drawing Sheets

FIREARMS WITH TARGET ILLUMINATORS

CROSS-REFERENCE

This is a continuation-in-part of U.S. patent application Ser. No. 08/849,566, filed May 27, 1997 by John Wallace Matthews Ph.D., now U.S. Pat. No. 6,112,962 one of the inventors herein, as national phase of International Application PCT/US95/09471, filed Jul. 26, 1995, and a continuation-in-part of U.S. patent application Ser. No. 08/985,556, filed Dec. 5, 1997 by the subject inventors, now U.S. Pat. No. 6,046,572, issued Apr. 4, 2000 assigned to the common assignee hereof, and herewith incorporated by reference herein.

FIELD OF INVENTION

The subject invention relates to firearms with target illuminators, to target illuminators for firearms, and to battery compartments and battery-driven appliances.

BACKGROUND

Numerous battery-driven appliances have been proposed and have been made over the years. An example thereof is seen in U.S. Pat. No. 5,654,594, by Bernie E. Bjornsen, III, Dr. Peter Hauk, and Dr. John W. Matthews, for Ergonomic Electrical Current Switching Systems, issued Aug. 5, 1997 to Laser Products Ltd., and hereby incorporated by reference herein.

Illustrated embodiments of that prior-art development include a firearm target illuminator laterally attached to the weapon. Typically, such target illuminator has a compartment for batteries that energize an electric light source through a switching device. Also typically, such light source is contained in a lamp module that is threaded onto the battery compartment. As development progresses, such threading of the lamp housing onto the battery compartment may eventuate misalignment among battery and lamp terminals.

SUMMARY OF THE INVENTION

Against this background and the broader prior art, the subject invention, from a first aspect thereof, resides in apparatus for firing projectiles at targets and for illuminating such targets, and more specifically resides in the improvement comprising, in combination, a projectile-firing weapon, a target illuminator including a battery compartment including battery elements, a substantially round contact plate interconnecting such battery elements and a contact plate retainer coupled to such contact plate and a contact plate retainer receptacle in the battery compartment jointly constituting a security against angular movement of such substantially round contact plate in the battery compartment, a track-and-slide combination including a slide on that target illuminator and a track on such weapon for that slide, and a releasable slide-in-track stop in such track-and-slide combination.

From a second aspect thereof, the invention resides also in apparatus for firing projectiles at targets with a firearm actuated by a bent trigger finger of a shooter, and for illuminating such targets, and more specifically resides in the improvement comprising, in combination, a target illuminator including a battery compartment including battery elements, a substantially round contact plate interconnecting such battery elements and a contact plate retainer coupled to such contact plate and a contact plate retainer receptacle in the battery compartment jointly constituting a security against angular movement of such substantially round contact plate in the battery compartment mounted on such firearm, and a push-button switch mounted within reach of a pad of that trigger finger prior to actuation of the firearm.

According to an embodiment of the invention, such combination may include the above mentioned track-and-slide combination and releasable slide-in-track stop.

From a second aspect thereof, the invention resides also in an electric appliance including batteries, and more specifically, resides in the improvement comprising, in combination, a battery compartment for such batteries, a contact plate interconnecting such batteries, a contact plate retainer coupled to that contact plate, and a contact plate retainer receptacle in that battery compartment.

Brief Description of the Drawings

The subject invention and its various aspects and objects will become more readily apparent from the following detailed description of preferred embodiments thereof, illustrated by way of example in the accompanying drawings which also constitute a written description of the invention, wherein like reference numerals designate like or equivalent parts, and in which.

DESCRIPTION OF EMBODIMENTS

The drawings show apparatus 10 for firing projectiles 12 at targets symbolically indicated at 13 and for illuminating such targets.

Figure 1:
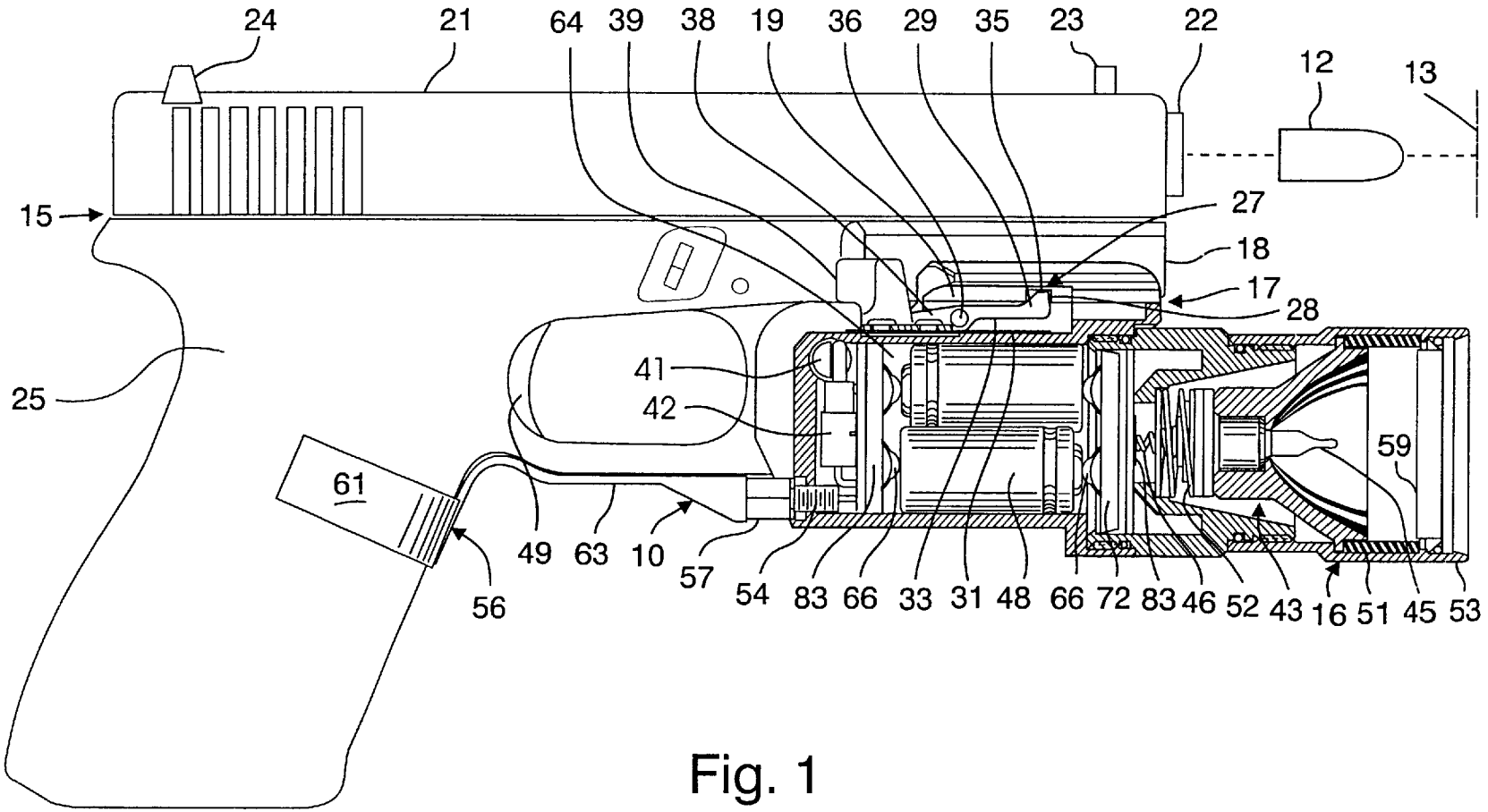
FIG. 1 is a partially sectioned side view of a firearm with target illuminator and target illuminator switch according to an embodiment of the invention.
Figure 2:
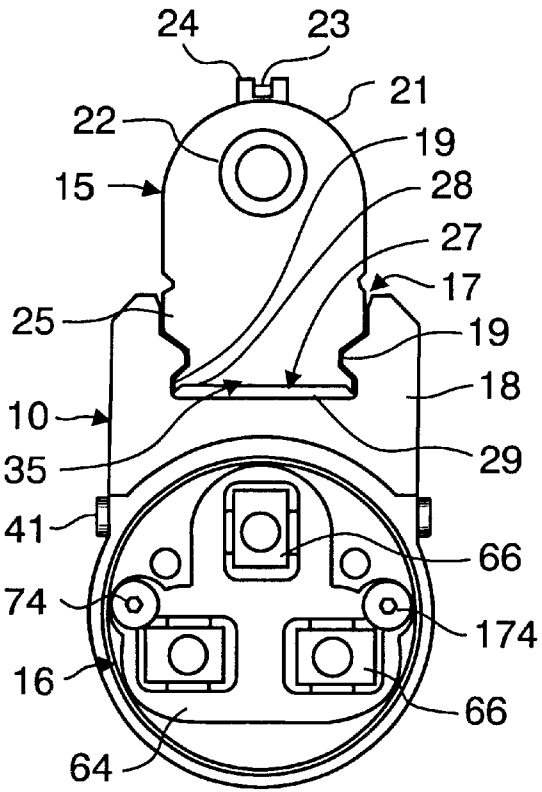
FIG. 2 is a front view of the firearm and target illuminator combination shown in FIG. 1, after removal of a frontal lamp module, contact plate and batteries for a better view of a battery compartment interior.
Figures 3, 4:
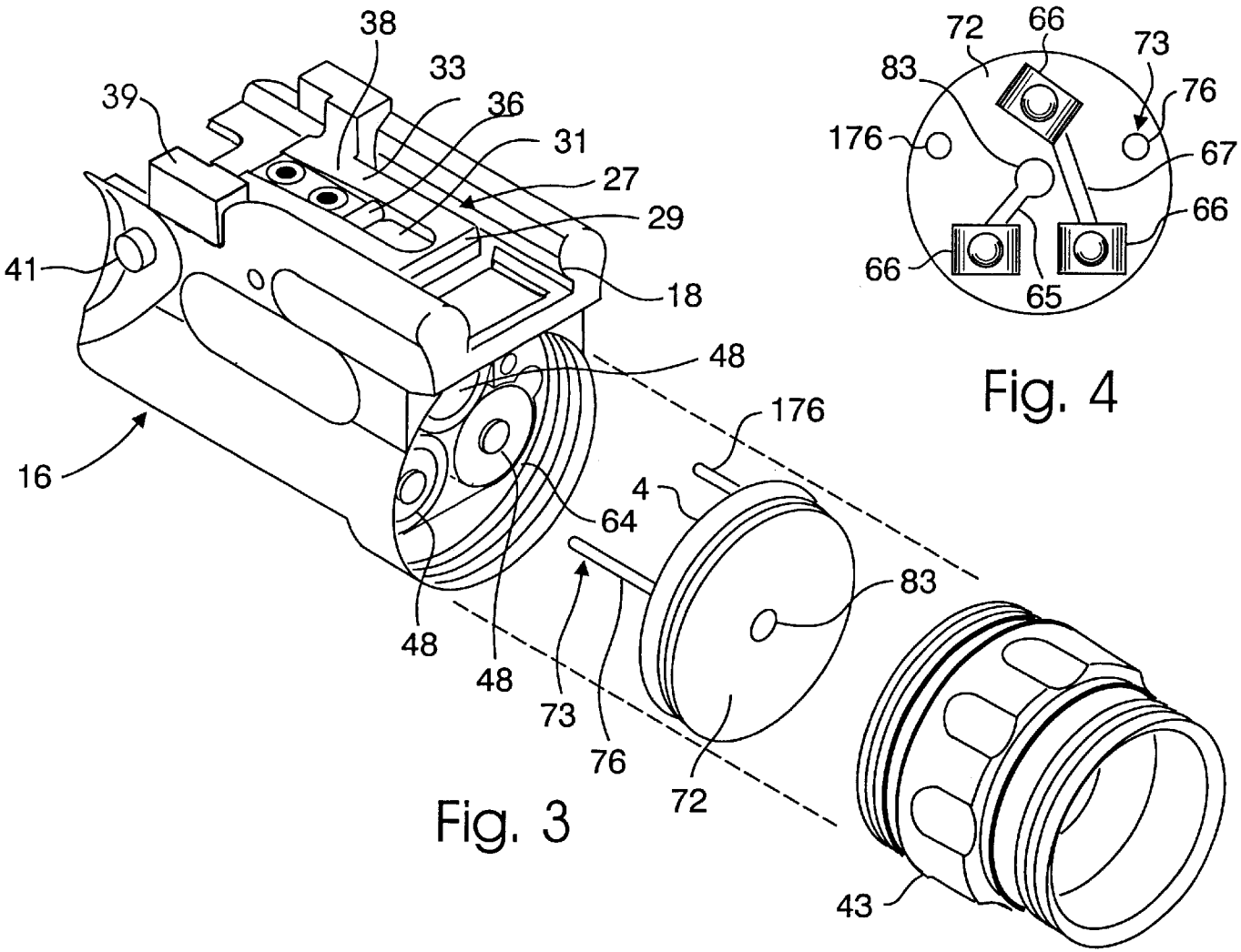
FIG. 3 is a perspective exploded view of the target illuminator of FIGS. 1 and 2.
FIG. 4 is a view of a contact plate or circuit board as seen in the direction of arrow 4 in FIG. 3.

FIGS. 1 to 3 show a handgun, firearm or other projectile firing weapon 15 and a target illuminator 16 in the apparatus 10 which also includes a track-and-slide combination 17 including for instance a slide 18 on the target illuminator 16 and a track 19 on the weapon 15 for such slide 18.

The weapon 15 also may have a component 21 traditionally known as its "slide" that customarily carries the weapon's barrel 22 and the typical front and rear sights 23 and 24, and that is capable of sliding on the receiver and frame 25 of the weapon. The slide 18 of the target illuminator 16, which slides in the track 19 of the weapon, is to be distinguished from the just described "slide" 21 of the weapon which slides on its receiver-frame 25.

Reference may also be had to the above mentioned International Application PCT/US95/09471, published Feb. 13, 1997 under Publication No. WO 97/05443 and hereby incorporated by reference herein. Such international application in its FIGS. 2, 2A and 2C discloses attachment of accessories, such as target illuminators, to hand weapons by means of a dovetail structure alternatively described as a bayonet socket or any other mount.

According to the embodiment of the invention illustrated in FIGS. 1 to 3, the apparatus 10 also includes a releasable slide-in-track stop 27 in the track-and-slide combination 17. As its name implies, such component 27 releasably stops the slide 18 of the target illuminator 16 in the track 19 of the weapon 15, whereby the target illuminator in effect becomes and remains part of the weapon, until it is intentionally removed therefrom.

Such releasable slide-in-track stop 27 includes a stop 28 on one of the above mentioned track 19 and slide 18, such as on the track 19, and a detent 29 on the other of such track 19 and slide 18, such as on the slide 18, releasably engaged with such stop 28 against a bias, such as provided by a leaf spring 31, for example.

Pursuant to a more specific embodiment of the invention, the releasable slide-in-track stop 27 includes a stop 28 on one of the above mentioned track and slide, such as on the track 19, and a manually actuable latch 33 on the other of such track and slide, such as on the slide 18. Such latch 33 is releasably engaged with the stop 28 against bias 31, such as at 29.

According to a preferred embodiment of the invention, the releasable slide-in-track stop 27 includes a cross slot 35 in track 19, and a detent 29 on the slide 18 releasably engaged with such cross slot as a stop 28. The manually actuable latch 33 on the slide 18 may be releasably engaged with such cross slot 35 against bias 31, such as about a pivot 36.

Pursuant to a preferred embodiment of the invention, the latch 33 has a center of mass 38 spaced from the pivot 36 so that the mass of the latch maintains that latch engaged with the stop 28 or cross slot 35 during recoil of the projectile-firing weapon 15. FIGS. 1 and 3 show such center of mass 38 located behind the pivot 36, as seen from said stop, for slides 18 of target illuminators 16 located below the barrel 22 or receiver-frame 25. However, such center of mass may have to be located between the latch detent or tip 29 and the latch pivot 36 for certain rifles or other weapon systems in which the target illuminator 16 with slide 18 is mounted above the projectile-firing barrel 22.

Reverting to the illustrated embodiment of the invention, the latch 33 may have an upturned handle or finger engagement portion 39 whose mass in effect shifts the center of mass 38 away from the latch pivot 36 toward the end of the latch at 39, opposite the detent or latch tip 29.

In practice, this prevents the recoil forces of the weapon 15 from causing the latch detent 29 to jump the stop 28 or cross slot 35 whereby the slide 18 and thereby the target illuminator 16 could objectionably move along the track 19 and eventually become disengaged from the weapon 15 while the weapon is being fired.

The apparatus may include a switch 41 for the target illuminator 16 on its slide 18. Such switch may have an OFF position and an alternative ON position. In the illustrated preferred embodiment of the invention, the switch 41 is a transverse shuttle switch; that is, the switch actuator at the lead line of reference numeral 41 operates transversely to the weapon 10 (e.g. in and out of the drawing of FIG. 1).

For best service to the marksperson or shooter, the switch 41 for the target illuminator 16 on the slide 18 preferably has an OFF position, an alternative releasably continuous ON position, and a momentary ON position. Switching devices which provide these three modes of operation are commercially available, and a block 42 in FIG. 1 is symbolic of such a switching device. By way of example, the OFF position of the switch 41 may be the center position of that transverse shuttle switch. Such transverse shuttle switch may be actuated or shifted to its alternative releasably continuous ON position, by a finger of the marksperson or shooter. Such transverse shuttle switch alternatively may be momentarily actuated or oppositely shifted to its momentary ON position by typically another finger of the marksperson or shooter; with the expression "finger" being considered sufficiently broad to cover a thumb as well.

In this respect and in general, the drawings show apparatus 10 for firing projectiles 12 at targets 13 with a firearm 15 having a trigger 49 which, as well known, is actuated by a bent trigger finger of a shooter. A target illuminator 16 is mounted on that firearm, such as in the manner mentioned above. A transverse shuttle switch or other push-button switch 41 is mounted within reach of a finger tip or pad of the mentioned trigger finger when outstretched prior to actuation of the trigger 49.

The marksperson or shooter thus may actuate the target illuminator light switch 41 as he or she draws the weapon. In many practical situations, this provides the best and fastest light switch control without impairment of a quick draw.

Additionally or alternatively, an electrical terminal 54 may be provided on the slide 18 for a switch for the target illuminator 16. The latter switch may be a familiar tape switch or another external switch on the weapon 15.

Figure 5:
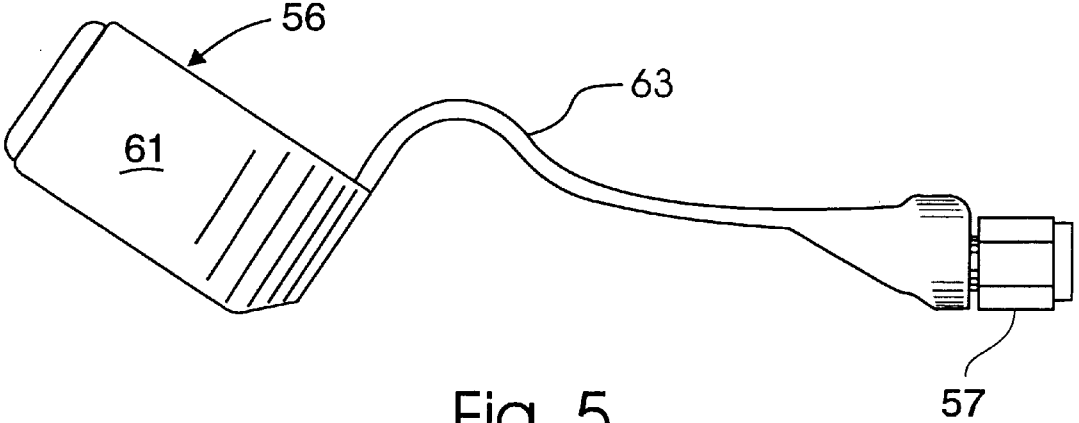
FIG. 5 is an enlarged view of the target illuminator switch shown in FIG. 1.

By way of example, FIG. 1 shows a switch 56 for the target illuminator 16 on the projectile-firing weapon 15, and an electrical terminal 54 on the slide 18 for that switch and for the target illuminator 16. FIG. 5 shows a detached side view of that switch 56. Such switch 56 may be called a slimline switch that ergonomically mounts on the weapon 15 for most effective actuation and that may have a switch terminal 57 for connection or connectable to its corresponding target illuminator terminal 54 for ON and OFF actuation of the illuminator 16.

Figure 6:
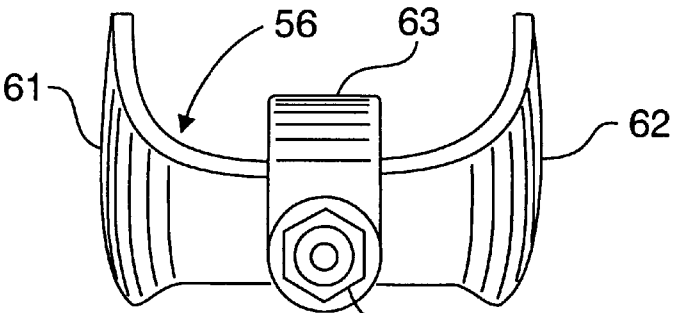
FIG. 6 is a frontal view of the target illuminator switch of FIG. 5 in a bilateral execution.

According to FIG. 6, the external switch 56 may be of a bilateral design having switch elements 61 and 62 on either side of the weapon 25 for easy access and convenient actuation. A switch element mount 63 that also comprises electrical leads to and from the switch elements extends from the switch terminal 57 to such elements 61 and 62. For such and similar switch configurations, reference may, for example, be had to the above mentioned U.S. Pat. No. 5,654,594, by Bernie E. Bjornsen, III, Dr. Peter Hauk, and Dr. John W. Matthews, for Ergonomic Electrical Current Switching Systems, issued Aug. 5, 1997 to Laser Products Ltd., and hereby incorporated by reference herein.

The illustrated apparatus also includes a compartment 64 for batteries 48. In this respect and in general, a standard dictionary definition of the term battery in electrical terminology is "(1) a group of two or more cells connected together to furnish electric current, (2) a single voltaic cell." In the same manner, The New IEEE Standard Dictionary of Electrical and Electronics Terms, published by The Institute of Electrical and Electronics Engineers (Fifth Edition, 1993), provides the following definition:

> "battery (primary or secondary). Two or more cells electrically connected for producing electric energy. [Common usage permits this designation to be applied also to a single cell used independently. In this document, IEEE Std 100, unless otherwise specified, the term 'battery' will be used in this dual sense.]"

Within the scope of the invention, a battery may simply be a single cell or element. However, when otherwise indicated, the subject disclosure and accompanying claims use the term battery in the ancient sense to refer to a combination of two or more primary or secondary cells or battery elements.

In particular, embodiments of the invention arrange the battery elements 48 side by side for the target illuminator 16 on the slide 18. Such side-by-side arrangement of the individual battery elements 48 advantageously avoids the recoil-related battery damage encountered in "in-line" battery systems in which two or more battery elements are arranged in series, with positive and negative terminals of adjacent battery elements touching each other. Each battery element 48 may be suspended by or supported between current pickup contacts 66 that act as individual shock absorbers for the battery elements in their compartment 64.

Figure 7:
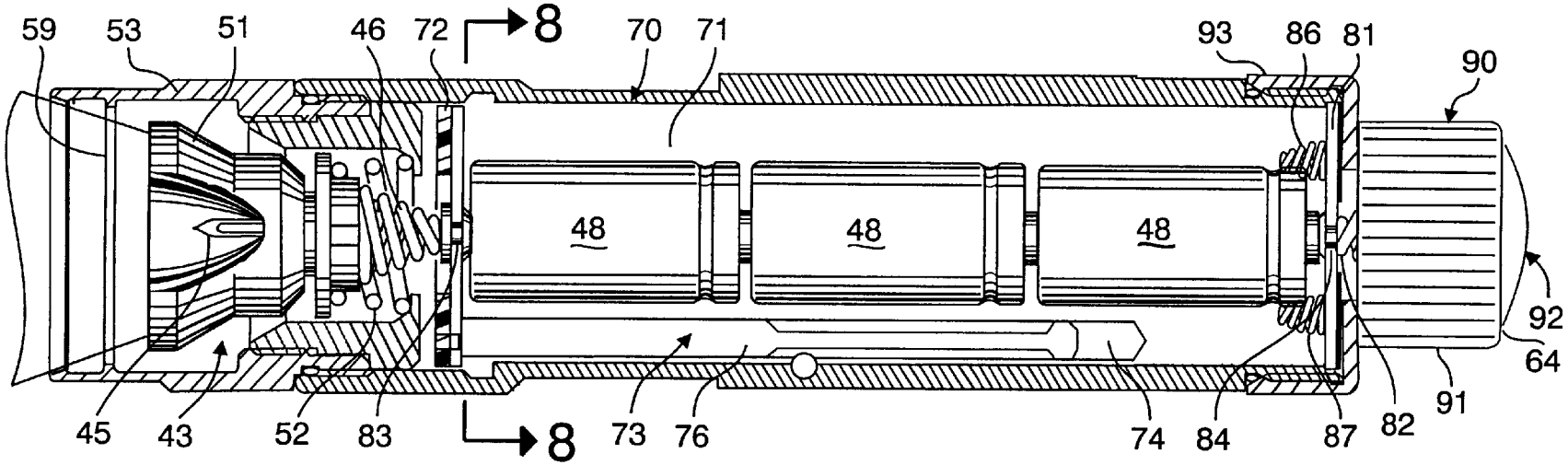
FIG. 7 is a longitudinal section through a battery-driven appliance having a contact plate mounting and alignment system according to an embodiment of the invention.

A frontal lamp module 43 is shown only in FIGS. 1 and 7, but would also be present in FIGS. 2 and 3, except that it has been omitted from those figures for a better view of the battery compartment interior 64. Such frontal lamp module 43 completes the target illuminator 16. The illustrated example of that module includes an electric lamp 45 energized by battery elements 48 through switches 41 and 56, terminals 66 and a terminal spring 46 interconnected therewith. The lamp 45 is mounted in a reflector 51 and is protected against weapon recoil and other shocks by a shock-absorber spring 52. A bezel 53 with lens or transparent cover plate 59 complete the lamp module.

FIGS. 1 to 4, 7 and 8 also show a contact plate mounting and alignment system according to another aspect of the invention. An example of a contact plate for or in such system is seen at 72 in FIGS. 1, 3, 4 and 7. As seen in FIG. 4 such contact plate 72 carries the above mentioned terminals 66 that are engaged or contacted by corresponding terminals of battery elements 48, such as seen in FIG. 1 and such as contemplated also for a mode of operation of the embodiment shown in FIGS. 7 and 8.

In particular, FIG. 7 is a longitudinal section through a flashlight or other battery-driven appliance 70 having a contact plate mounting and alignment system according to an embodiment of the invention. FIGS. 1 to 4, 7 and 8 show an electric appliance 16 or 70 including battery elements 48, a battery compartment 64 or 71 for such battery elements, a contact plate 72 interconnecting such battery elements, a contact plate retainer 73 coupled to that contact plate 72, and a contact plate retainer receptacle 74 in the battery compartment 64 or 71.

Figure 8:
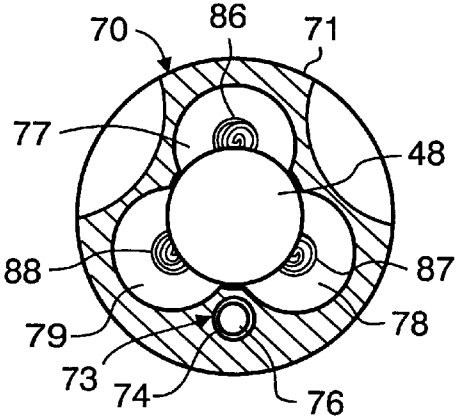
FIG. 8 is a section taken on the line 8-8 in FIG. 7.

According to the embodiments as seen in FIGS. 3, 4, 7 and 8, the contact plate retainer 73 includes a rod 76 coupled to the contact plate 72. In other words, the contact plate 72 may be mounted on the retainer 73 or rod 76. As seen in FIGS. 2, 7 and 8, the contact plate retainer receptacle may include at 74 a it corresponding bore for such rod 76 in the battery compartment 64 or 71.

Various circuits are known for connecting battery elements in series or for that matter in parallel or in any combination of series and parallel connection. By way of example, FIG. 4 shows a lead or bar 65 interconnecting one of the terminals 66 with a central terminal 83. FIG. 4 also shows a lead or bar 67 interconnecting the remaining two terminals 66 on that contact 43 plate 72. In this respect, the contact plate 74 may in fact be a circuit board.

An opposite contact plate or circuit board is shown at 81 in FIGS. 1 and 7. Such opposite contact plate or circuit board 81 may have similar leads or bars for further interconnecting terminals 66 or 86, 87 and 88 that are in contact with opposite terminals of battery elements 48. FIGS. 1 to 7 of the above mentioned U.S. patent application Ser. No. 08/985,556 show circuit boards and similar devices for effecting alternative series connections.

In this respect, FIG. 7 of this disclosure, as did FIG. 1 of that earlier Application Ser. No. 08/985,556, shows a series arrangement and connection of several battery elements. In particular, such battery elements 48 are connected in series between a load or lamp terminal or terminal spring 46 on the one hand, and a terminal 82 of a switch 90 on the other hand.

Similarly, the embodiment illustrated in FIGS. 1 to 4 has several battery elements 48 connected in series between the load or lamp terminal or terminal spring 46 on the one hand, and terminals of switches 42 and 56 on the other hand. According to the preferred embodiment of FIGS. 1 to 4, these battery elements 48 advantageously are arranged side by side.

A similar arrangement is provided for in the embodiment of FIGS. 7 and 8 where spaces 77 to 79 in the battery compartment 71 permit the reception of three battery elements or combinations side by side, instead of the one string of battery elements 48 shown in FIG. 7. Shock absorbing current pickup contacts 66 may also be used in the embodiment of FIGS. 7 and 8, as in the embodiment of FIGS. 1 to 4, or shock-absorbing contact springs, such as seen at 86 to 88 in FIGS. 7 and 8 may be used in the embodiment of FIGS. 1 to 4 as well.

In both kind of embodiments, central terminals 83 and 84 or equivalents thereof may be provided in the first and second contact plates or circuit boards 72 and 81 for interconnecting whatever arrangement of battery elements 48 with the load or lamp terminal 46 on the one hand and the switch 42, 56 and 90, or switch terminal 82, on the other hand.

The first contact plate 72 may be moveable relative to a remainder of the appliance 16 or 70 or relative to the battery compartment 64 or 71. By way of example, the first contact plate 72 may be located on a retainer 73 that releasably retains such contact plate at a housing of the appliance, such as at the battery compartment 64 or 71.

By way of example, the retainer 73 may comprise a rod 76 which, in turn, may be axially moveable in a corresponding bore 74 in the battery compartment or other housing of the appliance.

In this manner the contact plate 72 may be lifted or swung out of the way and battery elements may be inserted into, and may be removed from, the battery compartment 64 or 71 through its top, after temporary removal of the load or lamp assembly 43 therefrom, as suggested by the exploded view of FIG. 3. After completion of such an operation, the contact plate 72 may be moved or swung back into its normal position such as seen in FIGS. 1 and 7.

According to the embodiment shown in FIGS. 1 to 4, the contact plate retainer 73 includes a pair of spaced rods 76 and 176 coupled to the contact plate 72. The above mentioned contact plate retainer receptacle also may include a pair of spaced corresponding bores 74 and 174 in the battery compartment, such as seen in FIG. 2, for the pair of spaced rods 76 and 176 specifically shown in FIGS. 3 and 4.

A socket is threaded in the battery compartment at the contact plate 72, such as in the form of a lamp module 43 as shown in FIGS. 1 and 7. The contact plate retainer system of the currently discussed aspect of the invention, such as embodied at 73 in FIGS. 3 and 7 and described above, effectively precludes undesirable angular movement of the round contact plate 72 and misalignment of contact plate terminal 66 and the like relative to terminals of battery elements 48 when the socket or lamp module 43 is threaded into the battery compartment 46 or 71. This effectively overcomes a problem that arose with progressive development and sophistication of battery compartment and power supplies.

This extensive disclosure will render apparent or suggest to those skilled in the art various modifications and variations within the spirit and scope of the invention.

We claim:

1. In apparatus for firing projectiles at targets and for illuminating said targets, the improvement comprising in combination:

a projectile-firing weapon;

a target illuminator including a battery compartment including battery elements, a substantially round contact plate interconnecting said battery elements and a contact plate retainer coupled to said contact plate and a contact plate retainer receptacle in said battery compartment jointly constituting a security against angular movement of said substantially round contact plate in said battery compartment;

a track-and-slide combination including a slide on said target illuminator and a track on said weapon for said slide; and a releasable slide-in-track stop in said track-and-slide combination.

2. Apparatus as in claim 1, including:

a switch for said target illuminator on said slide having an OFF position, and an alternative ON position.

3. Apparatus as in claim 2, wherein:

said switch is a transverse shuttle switch.

4. Apparatus as in claim 1, including:

a switch for said target illuminator on said slide having an OFF position, an alternative releasably continuous ON position, and a momentary ON position.

5. Apparatus as in claim 4, wherein:

said switch is a transverse shuttle switch.

6. Apparatus as in claim 1, including:

an electrical terminal on said slide for a switch for said target illuminator.

7. Apparatus as in claim 6, including:

an electrical switch terminal connectable to said electrical terminal on said slide.

8. Apparatus as in claim 1, including:

a switch for said target illuminator on said projectile-firing weapon; and an electrical terminal on said slide for said switch and for said target illuminator.

9. In apparatus for firing projectiles at targets with a firearm actuated by a bent trigger finger of a shooter, and for illuminating said targets, the improvement comprising in combination:

a target illuminator mounted on said firearm including a battery compartment including battery elements, a substantially round contact plate interconnecting said battery elements and a contact plate retainer coupled to said contact plate and a contact plate retainer receptacle in said battery compartment jointly constituting a security against angular movement of said substantially round contact plate in said battery compartment; and a push-button switch mounted within reach of a pad of said trigger finger when outstretched prior to actuation of said firearm.

10. Apparatus as in claim 9, wherein:

said push-button switch is a transverse shuttle switch.

11. Apparatus as in claim 9, including:

a track-and-slide combination including a slide on said target illuminator and a track on said firearm for said slide; and a releasable slide-in-track stop in said track-and-slide combination.

12. An electric appliance as in claim 1, wherein:

said contact plate retainer includes a rod coupled to said contact plate.

13. An electric appliance as in claim 12, wherein:

said contact plate retainer receptacle includes a corresponding bore for said rod in said battery compartment.

14. An electric appliance as in claim 1, wherein:

said contact plate retainer includes a pair of spaced rods coupled to said contact plate.

15. An electric appliance as in claim 14, wherein:

said contact plate retainer receptacle includes a pair of spaced corresponding bores for said pair of spaced rods in said battery compartment.

16. An electric appliance as in claim 1, including:

a socket threaded to said battery compartment at said contact plate.

17. An electric appliance as in claim 1, wherein:

said battery elements have terminals adjacent said contact plate; and contact plate includes a circuit board interconnecting said terminals.

18. An apparatus as in claim 9, wherein:

said contact plate retainer includes a rod coupled to said contact plate.

19. An apparatus as in claim 18, wherein:

said contact plate retainer receptacle includes a corresponding bore for said rod in said battery compartment.

20. An apparatus as in claim 9, wherein:

said contact plate retainer includes a pair of spaced rods coupled to said contact plate.

21. An apparatus as in claim 20, wherein:

said contact plate retainer receptacle includes a pair of spaced corresponding bores for said pair of spaced rods in said battery compartment.

22. An electric appliance as in claim 9, including:

a socket threaded to said battery compartment at said contact plate.

23. An electric appliance as in claim 9, wherein:

said battery elements have terminals adjacent said contact plate; and said contact plate includes a circuit board interconnecting said terminals.

* * * * *